US006220785B1

(12) United States Patent
Kennedy et al.

(10) Patent No.: US 6,220,785 B1
(45) Date of Patent: Apr. 24, 2001

(54) MINE STOPPING, METHOD OF CONSTRUCTING SAME AND PANELS THEREOF

(75) Inventors: William R. Kennedy; John M. Kennedy, both of Taylorville, IL (US)

(73) Assignee: Jack Kennedy Metal Products & Buildings, Inc., Taylorville, IL (US)

( * ) Notice: Subject to any disclaimer, the term of this patent is extended or adjusted under 35 U.S.C. 154(b) by 0 days.

(21) Appl. No.: 09/301,039

(22) Filed: Apr. 28, 1999

(51) Int. Cl.[7] ..... E21D 9/14; F21F 5/00

(52) U.S. Cl. ..... 405/132; 405/288; 454/169; 299/12

(58) Field of Search ..... 405/132, 144, 405/150.1, 150.2, 288, 290, 287; 454/168, 169, 170, 177; 299/11, 12

(56) References Cited

U.S. PATENT DOCUMENTS

| | | | |
|---|---|---|---|
| Re. 32,675 | 5/1988 | Kennedy et al. | 405/132 |
| Re. 32,871 | 2/1989 | Kennedy et al. | 405/132 |
| Re. 34,053 | 9/1992 | Kennedy et al. | 405/132 |
| Re. 34,220 | 4/1993 | Kennedy et al. | 405/132 |
| 2,729,064 | 1/1956 | Kennedy et al. | 61/45 |
| 3,302,343 | 2/1967 | Bear | 52/98 |
| 4,036,024 | 7/1977 | Dreker et al. | 61/42 |
| 4,294,563 | 10/1981 | Kilburn | 405/132 |
| 4,478,535 | 10/1984 | Kennedy et al. | 405/132 |
| 4,483,642 | 11/1984 | Kennedy et al. | 405/132 |
| 4,484,837 | 11/1984 | Kennedy et al. | 405/132 |
| 4,547,094 | 10/1985 | Kennedy et al. | 405/132 |
| 4,784,522 * | 11/1988 | Mraz | 299/11 |
| 4,820,081 | 4/1989 | Kennedy et al. | 405/132 |
| 5,167,474 | 12/1992 | Kennedy et al. . | |
| 5,168,667 | 12/1992 | Kennedy et al. | 49/394 |
| 5,401,120 * | 3/1995 | Hussey et al. | 405/132 |
| 5,725,327 * | 3/1998 | Hussey et al. | 405/132 |
| 5,879,231 * | 3/1999 | Sisk | 405/132 |

FOREIGN PATENT DOCUMENTS

WO 85/04444 10/1985 (EP) .

* cited by examiner

*Primary Examiner*—Thomas B. Will
*Assistant Examiner*—Frederick L. Lagman
(74) *Attorney, Agent, or Firm*—Senniger, Powers, Leavitt & Roedel

(57) ABSTRACT

A permanent mine stopping comprising two spaced-apart metal walls with a filling in the space therebetween keyed or adhesively bonded to the walls and having sufficient strength in tension to constitute the walls and the filling as a permanently integrated composite structure in which the walls act as flanges in conjunction with the filling as a web. Also, a method of constructing the stopping using extensible panels to construct the walls, and an extensible panel for use in constructing a stopping with the keying.

23 Claims, 6 Drawing Sheets

MINE STOPPING, METHOD OF CONSTRUCTING SAME AND PANELS THEREOF

BACKGROUND OF THE INVENTION

This invention relates to a mine stopping, a method of constructing the stopping, and panels used therein, more particularly a permanent mine stopping generally for the same purpose as the stopping disclosed in U.S. Pat. No. 5,167,474 of myself and John M. Kennedy, issued Dec. 1, 1992, entitled Form for Making a Permanent Concrete Mine Stopping, a method of constructing a permanent stopping, and panels such as used in the constructing the stopping and which become synergistically incorporated therein.

U.S. Pat. No. 5,167,474 discloses a method of constructing a mine stopping by erecting two steel walls indicated at W1 and W2 in the patent each comprising a set 3 of elongate extensible steel panels 7 with the walls spaced apart in a passageway in a mine, pouring concrete or other suitable commercially available material sufficiently strong when hardened to provide a permanent stopping to seal off an unworked portion of a mine as disclosed in the patent, and removing the walls after the concrete (or equivalent) has hardened, leaving a concrete (or equivalent) wall per se as a permanent stopping.

Also in the background of the invention is a mine stopping made in a manner similar to that shown in U.S. Pat. No. 5,164,474 with the differences that a yielding foamed cement is poured between the walls, resulting in a permanent stopping with near zero leakage of air past the stopping.

BRIEF SUMMARY OF THE INVENTION

Among the several objects of this invention may be noted the provision of a near zero leakage permanent mine stopping improved over the above noted permanent mine stoppings in enabling reduction of thickness of the stopping for cost reduction while retaining strength in resistance to forces tending to cause failure of the stopping, such as forces against a face of the stopping resulting from an explosion in the mine; and the provision of a method of and panels for constructing the improved stopping.

In general, a stopping of this invention for a passageway in a mine comprises first and second walls extending transversely of the passageway from one side thereof to the other and heightwise of the passageway from the floor to the roof thereof, the walls being permanently held in generally vertical parallel relation spaced apart longitudinally of the passage and held against displacement longitudinally of the passageway, and a filling in the space between the walls having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passage.

In general, the method of this invention for providing a stopping for a passageway in a mine comprises installing first and second walls extending transversely of the passageway generally from one side thereof to the other and heightwise of the passageway from the floor to the roof thereof, said walls as installed being permanently held in generally vertical parallel relation spaced apart longitudinally of the passageway and held against displacement longitudinally of the passageway, filling the space between the walls with a material initially in a fluent state and adapted to set in situ to a final state, wherein it has strength in tension as well as compression, said material being delivered into said space in its fluent state and allowed to set in situ to its final state, and providing a force-transmitting relationship between the filling and the walls, the filling in its final state having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passage.

In general, a panel of this invention, for use in constructing a stopping as set forth above, comprises a first elongate sheet metal member constituting a lower member of the panel adapted for engagement of its lower end with the floor of the passageway, and a second elongate sheet metal member constituting an upper member of the panel adapted for engagement of its upper end with the roof of the passageway, said members having a telescoping sliding fit with one another to permit adjustable extension of the panel to fit the height of the passageway, each member having an inside face and an outside face in respect to incorporation of the panel in a stopping, each member having on the inside face thereof means for keying the filling and said members together.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
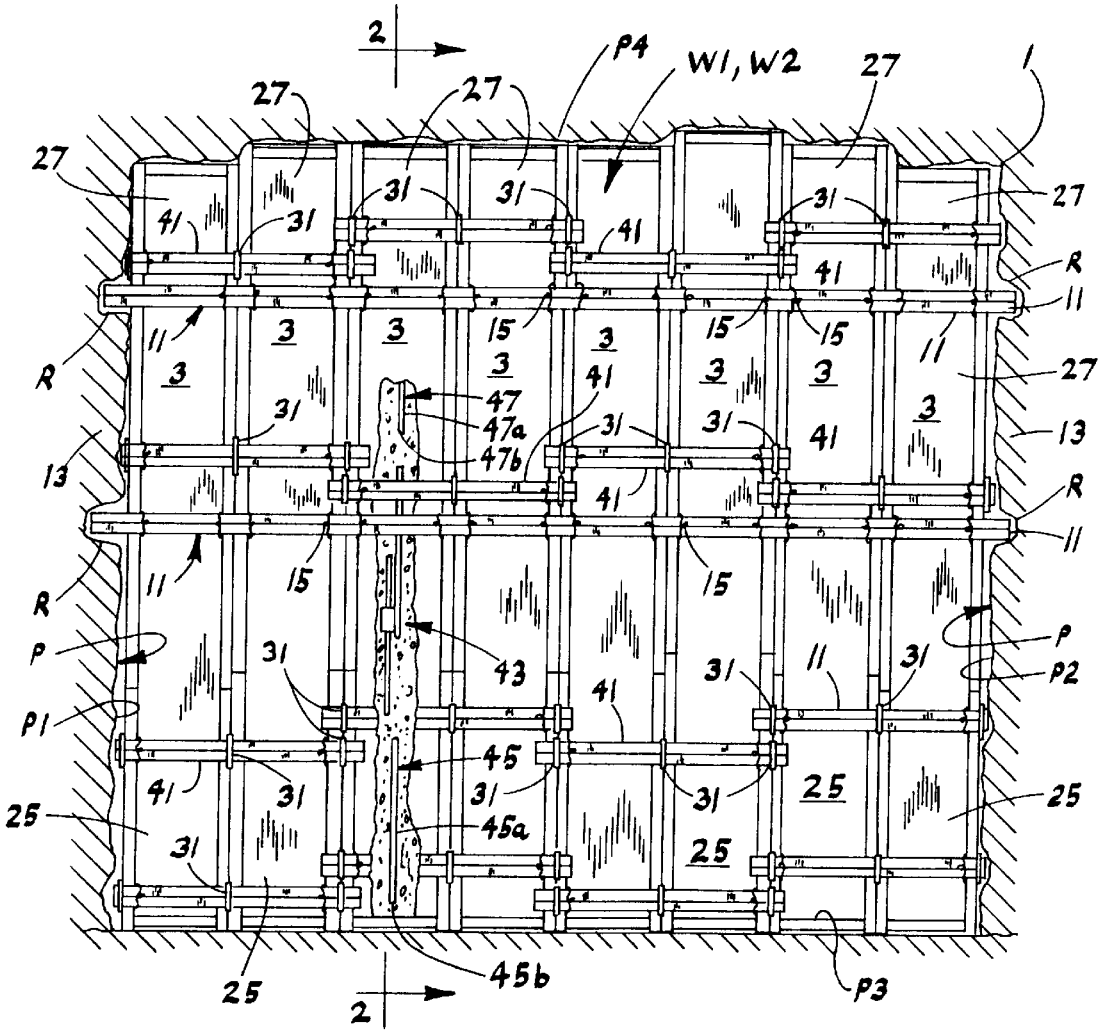
FIG. 1 is a view in elevation of one face of a stopping of this invention in a passageway in a mine, with parts broken away to show interior detail.

Referring to the drawings, first more particularly FIGS. 1–5, there is generally indicated at 1 a stopping of this invention for a passageway P in a mine. The stopping is shown basically to comprise first and second sheet metal walls W1 and W2 extending transversely of the passageway from one side P1 thereof to the other P2 and heightwise of the passage from the floor P3 to the roof P4 thereof. The walls W1 and W2 are permanently held in generally vertical parallel relation spaced apart longitudinally of the passageway, defining a space 2 between the walls, being held against displacement longitudinally of the passageway in a manner to be described. Filling the space 2 between the walls W1 and W2 is a filling F having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway.

Each of the walls W1 and W2 comprises a set of elongate extensible panels, each generally designated 3 of the type described in U.S. Pat. No. 4,483,642 of myself and John M. Kennedy, issued Nov. 20, 1984, and U.S. Pat. No. 5,167,474 referred to above, these two patents being incorporated herein by reference. Each set of panels includes a plurality of panels 3 erected in the passageway extending vertically in side-by-side relation as shown in FIGS. 1 and 3 from the floor P3 to the roof P4 of the passageway P. As best illustrated in FIG. 2, the two sets of panels 3 are erected with the panels of one set constituting the first (front) generally vertical wall W1 of the stopping 1 and the panels of the other set constituting the second (back) generally vertical wall W2 of the stopping generally parallel to and spaced from the front wall W1 defining the space 2 filled with the filling F.

Each wall W1, W2 further comprises a plurality of support bars 11 (two being shown) extending substantially horizontally between ribs 13 at opposite sides of the mine passageway, the ends of the bars being received in recesses R in the ribs. The panels 3 making up the wall are secured to these bars 11 by a plurality of U-shaped wire ties 15, each tie having a hook 17 at each end engageable with one of the panels and a central portion 21 which is twisted so as to deform the tie around the bar to hold the respective panel 3 in engagement with the bar. Preferably, each support bar 11 comprises two or more steel angles, one angle overlapping another at their inner end margins, the angles being secured together by ties 15 at said inner end margins thereof.

Figure 2:
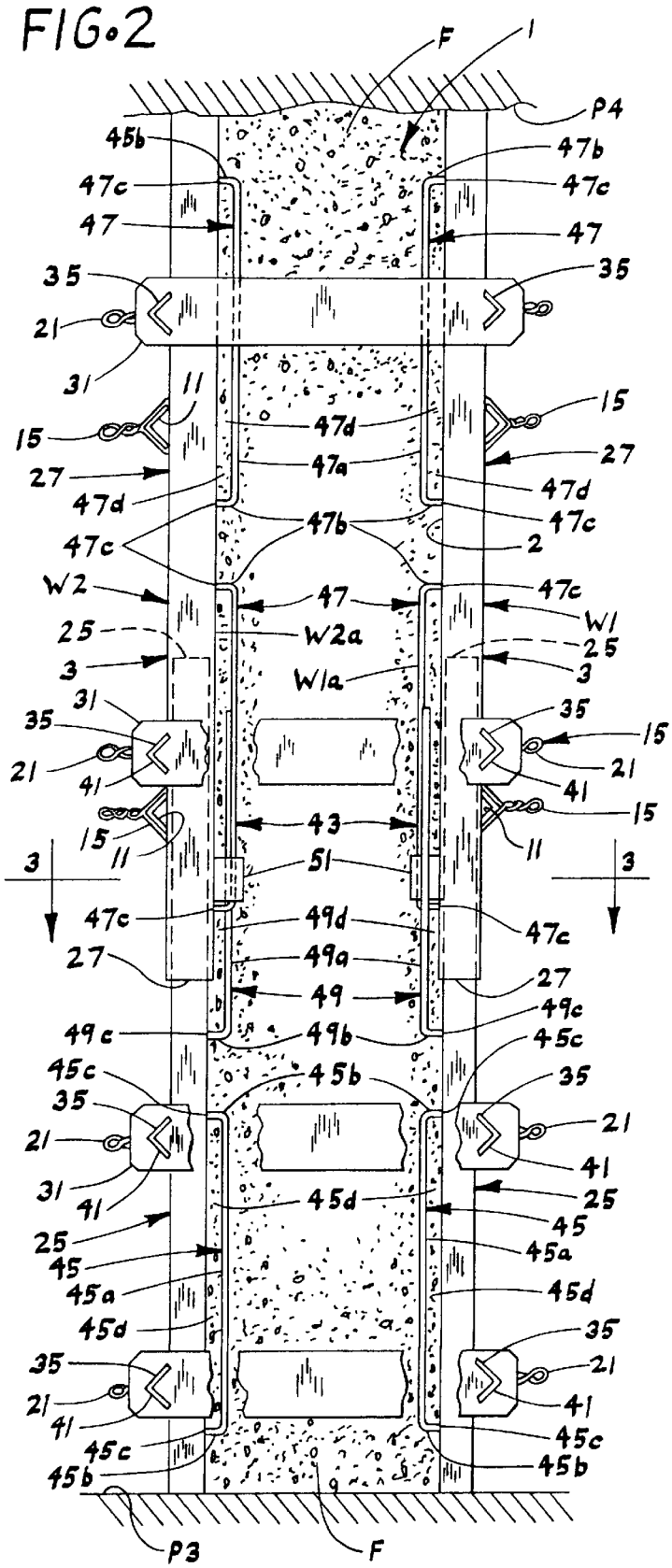
FIG. 2 is a vertical section taken on line 2—2 of FIG. 1, with parts broken away.
Figure 3:
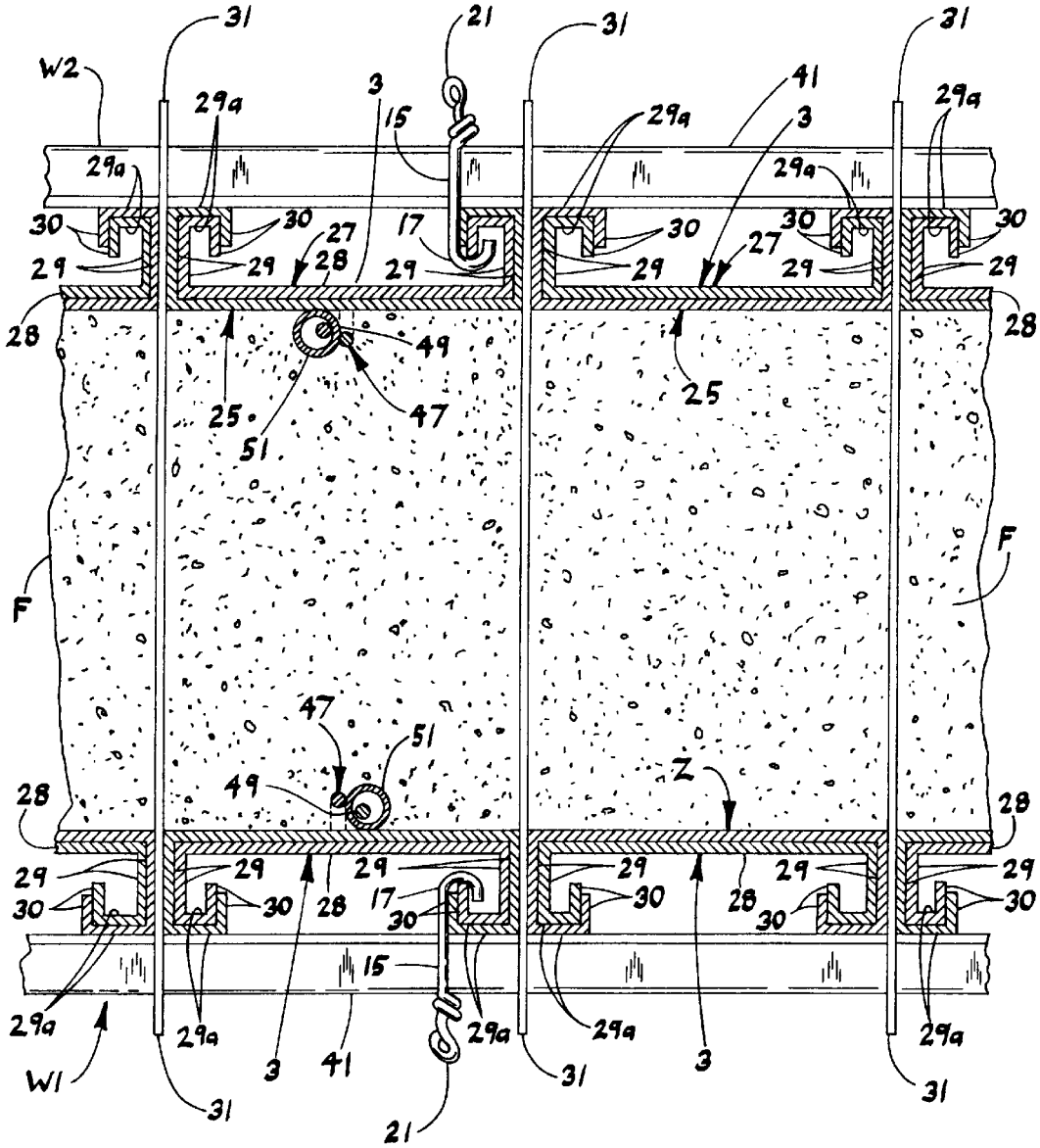
FIG. 3 is a view in horizontal section on line 3—3 of FIG. 2 on a larger scale than FIG. 2.
Figure 4:
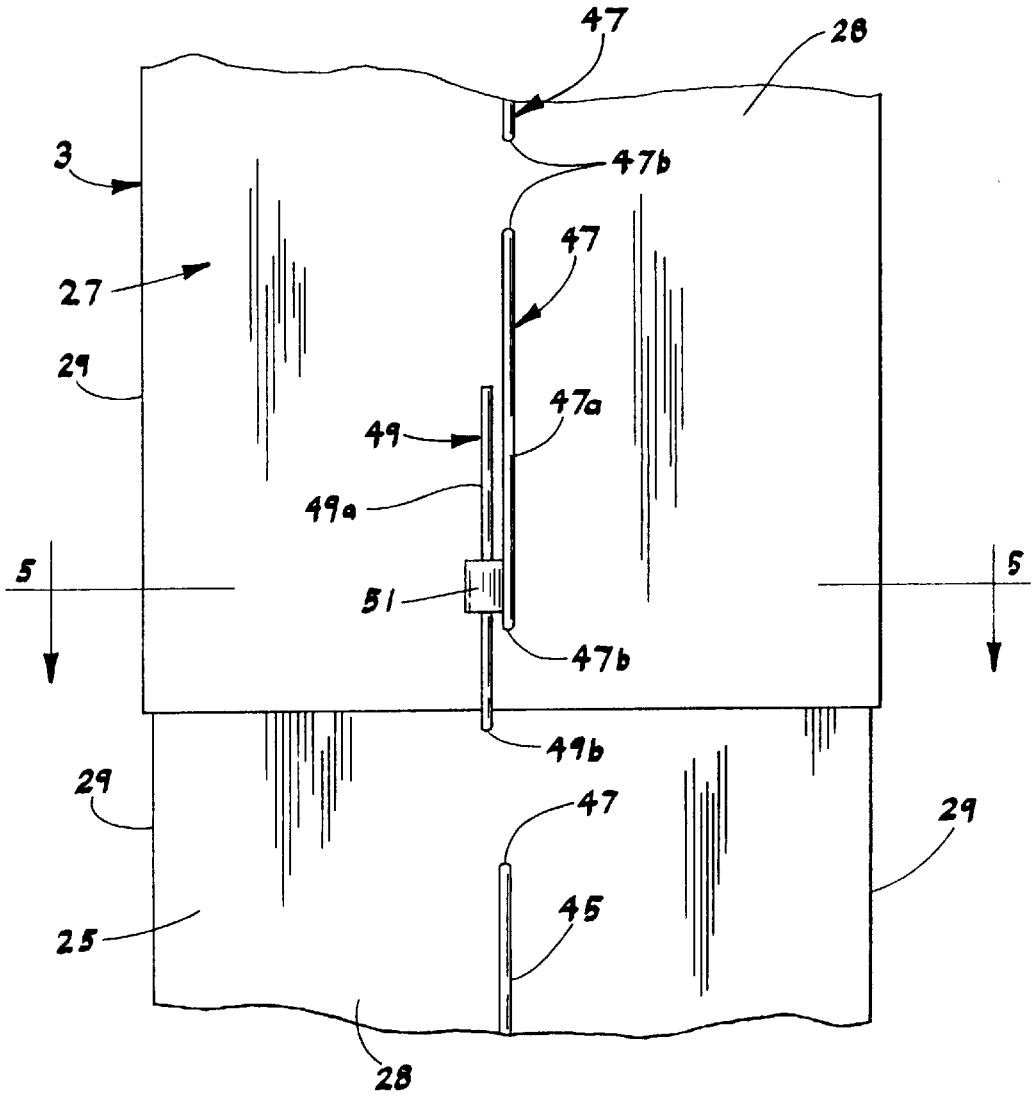
FIG. 4 is a view in elevation of one face (the inside face) of part of an extensible panel of this invention used in constructing a stopping of this invention.
Figure 5:
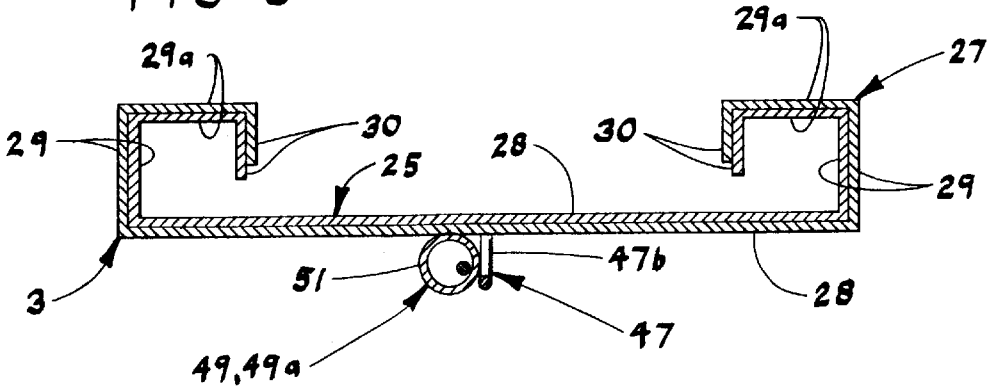
FIG. 5 is a view in horizontal section on line 5—5 of FIG. 4.

Each of the panels 3 comprises a first elongate member 25 constituting a lower member of the panel adapted for engagement of its lower end with the floor of the passageway (as shown in FIGS. 1 and 2), and a second elongate member 27 constituting an upper member of the panel adapted for engagement of its upper end with the roof of the passageway. Each panel member 25, 27 is a sheet metal member of channel space in cross section, having a web 28 and flanges 29 at opposite sides of the web. As shown in FIGS. 3 and 5, each flange 29 has an inturned portion 29A at its outer edge extending generally parallel to the web and a lip 30 at the inner edge of the inturned portion extending toward the web. The upper and lower panel members 25, 27 have a telescoping sliding fit with one another to permit adjustable extension of the panel to fit the height of the passageway. The panel members 25, 27 are secured in adjusted position to a support bar 11 by hooking the hook ends 17 of two wire ties 15 onto the lips 30 of the telescoped panel members, and then twisting the central portions 21 of the ties to clamp the upper and lower members of each panel in fixed position relative to one another. Reference may be made to U.S. Pat. No. 4,483,642 and U.S. Pat. No. 5,167,474 for further detail as to the construction and use of these panels 3. When erect, the panels 3 making up the front and back walls W1, W2 are oriented so that the channel defined by each panel opens outwardly away from the inside of the wall. In other words, the webs 28 of the channel-shaped panels face inwardly in relation to the stopping.

Each wall also includes means comprising a plurality of tie bars, each designated 31, for holding them in spaced, generally parallel relation prior to, during and immediately after filling of the space between the walls. These ties 31 are formed from sheet metal (e.g., 12 ga. steel), are generally rectangular in shape, and extend generally horizontally between the walls W1, W2, each bar having a length greater than the spacing between the walls W1, W2 so that the ends of the bar extend endwise outwardly through openings in the walls formed by gaps between adjacent panels 3 of the walls (the gaps between adjacent panels are sufficiently wide to enable passage of the relatively thin tie bars, but sufficiently narrow to substantially prevent the escape of the filling material). The end of each tie bar 31 has a chevron-shaped opening or slot in it, as indicated at 35 in FIG. 2, the chevron being disposed with its apex generally in the central longitudinal axis of the bar and pointing toward its respective end of the bar. The tie bars 31 are arranged in groups of three, for example, with the openings 35 in the tie bars of each group being in horizontal alignment. The tie bars of each group are preferably spaced at panel-width intervals, as shown in FIGS. 1 and 3.

The tie bars 31 are secured to the front and back walls W1, W2 of the form by means of braces 41 constituted by horizontal steel angles having a cross sectional shape corresponding to that of the chevron-shaped slots 35 in the ends of the tie bars. The arrangement is such that a single brace 41 on the outside of the front wall W1 is adapted to extend through aligned openings 35 in the forwardly protruding ends of the tie bars 31 of a single group of tie bars, and another brace 41 on the outside of the back wall W2 is adapted to extend through aligned openings 35 in the rearwardly protruding ends of the same group of tie bars. The braces 41 are secured to the panels 3 in suitable fashion, as by the wire ties 15 described above, with each brace bar oriented so that its legs are engageable with the inturned portions 29A of the flanges 29 of adjacent panels as shown in FIGS. 2 and 3. The length of each brace 41 will depend on the number and spacing of the ties bars 31 in each group. However, as depicted in FIG. 1, each brace 41 has a length greater than the combined widths of two adjacent panels so that it may secure at least three tie bars 31 spaced at panel-width intervals. It will be understood that the number of tie bars 31 in each group, the lengths of the braces 41, and the arrangement of the groups of the tie bars may vary, the important criteria being that the tie bars 31 and braces 41 be so located and arranged as to provide the panel rigidity and support necessary for withstanding the pressures involved during the pouring and setting of the filling process. It will be noted in this regard that the tie bars 31 should be used more frequently toward the bottom of the form, since the hydraulic pressures involved at this location are the greatest. The tie bars 31 also provide limited structural reinforcement to the filling after it has set.

In the embodiment of the invention shown in FIGS. 1–5, the force-transmitting relationship of the filling F with the walls W1 and W2 is established by means indicated in its entirety by the reference numeral 43 on the inside force W1*a* and W2*a* of the walls keying the filling and the walls together. The keying means 43 comprises metal bars such as indicated at 45 and 47 secured to the inside faces W1*a* and W2*a* of the walls W1 and W2 embedded in the filling F. One or more bars 45 may be provided on the inside face of the lower section 25 of each extensible panel or on the inside face of the lower section of at least some of the extensible panels. One or more bars 47 may be provided on the inside face of the upper section of each extensible panel, or on the inside face of the upper section of at least some of the extensible panels. Each of the bars 45, 47 has a straight reach 45*a*, 47*a* and end portions 45*b*, 47*b* bent to extend laterally generally at right angles to the straight section from the ends of the straight section. Each bar 45, 47 extends generally vertically on the inside face of the respective panel section, having its end portions 45*b*, 47*b* extending toward inside face of the respective panel section and welded at their ends 45*c*, 47*c* to the inside face of the respective panel section. With the bars 45, 47 so disposed, a space 45*d*, 47*d* is provided between the straight reach 45*a*, 47*a* and the inside face of the respective wall W1 and W2, the filling F penetrating these spaces on the inside of the walls for embedment of the bars in the filling and resultant keying of the filling and the walls.

Referring more particularly to FIG. 2, it will be observed that the lower ends of the bars 45 on the inside of the lower sections 25 of the extensible panels which have these bars are spaced a relatively short distance up from the lower ends of the lower sections, and the upper ends of these bars are spaced a relatively long distance down from the upper ends of the lower sections. Also, the upper ends of the bars 47 on the inside of the upper sections 27 of the extensible panels which have bars 47 are spaced a relatively short distance down from the upper ends of the upper sections, and the lower ends of bars 47 are spaced a relatively long distance up from the lower ends of the upper sections. For keying the filling to the walls W1 and W2 in the areas thereof between the upper ends of bars 45 and the lower ends of bars 47, one member, more particularly the lower section 25 of at least some of the extensible panels, has an auxiliary bar 49 secured at one end on the inside face of said lower section with a space between said auxiliary bar 49 and the lower section, each said auxiliary bar extending lengthwise of the respective panel through a tubular guide 51 on the inside face of the other section of the extensible panel (the upper section as shown). Each auxiliary bar has an elongate straight reach 49*a* which extends generally vertically on the inside of the lower and upper sections of the respective extensible panel and a lower end portion 49*b* bent to extend laterally outward from the straight reach generally at 90°, said lower end portion being welded at its outer end 49*c* to the inside of the lower panel section. The arrangement is such as to allow for the extension and contraction of the extensible panel and the provision of a space 49*d* between the auxiliary bar and the respective panel members for penetration of the filling into said space for keying the filling to the walls in said areas on the inside of the walls between the upper ends of bars 45 and the lower ends of bars 47.

As noted above, for the construction wherein each of the walls W1 and W2 comprises the extensible panels with at least some of the panels with the keying means comprising bars 45, 47 and 49, the filling F may be a concrete material or other material which is initially in a fluent state for being poured between the walls and which sets in situ to a final state wherein it has strength in tension as well as in compression. An example of such other material which may be suitable is a polyurethane foam having the following physical characteristics:

| | |
|---|---|
| Expansion Ratio | 6 fold |
| Compressive Strength | 16.7 psi parallel<br>11.3 psi perpendicular |
| Tensile Strength | 27.7 psi parallel<br>24.5 psi perpendicular |
| Cell structure | closed |
| Surface Formed | skin |

Other possible foaming fluids include phenolic foaming fluid and foamed portland or alumia cement. One foaming fluid which may be particularly suitable is a commercially available flame-inhibited polyurethane foam from RHH Foam Systems, Inc., located in Cudahy Wisconsin, sold under the trade designation VERSIFOAM.

An important consideration is that the filling, in its final set state in place between the walls W1, W2 has sufficient strength in tension as well as compression to transmit diagonal tension forces in the filling to the walls W1, W2 (corresponding to the transmission of diagonal forces in the web of an I-beam to the flanges of the I-beam). And for such transmission of diagonal tension forces in the filling to the walls W1, W2 there must be a force-transmitting relationship of the filling with the walls, such as achieved in the stopping as shown in FIGS. 1–5 by the keying bars 45, 47 and 49.

To make a stopping of this invention, one wall, e.g. the back wall W2, is first erected in a manner described herein and in the aforesaid U.S. patents, that is, by making holes R in the ribs of the mine passageway and inserting therein the ends of the support bars 11. One of the panels 3 is then positioned against the bars with the side of the panel in engagement with the rib 13 at one side of the passageway. Wire ties 15 are placed over the support bars 11 with the hooks 17 hooking onto the lips 30 of the panel as described herein and in said U.S. patents to hold the panel against the support bars. The panel 3 is then extended to move its lower end into sealing engagement with the floor P3 of the passageway, and its upper end into sealing engagement with the roof P4 of the passageway. The central portions 21 of the wire ties are then twisted to secure the panel to the support bar with the panel held in extended position. A second panel 3 is installed at the other rib 13 of the mine passageway in a manner similar to that just described. Additional panels are similarly installed in side-by-side relation between the first and second panels to form an array of panels across the entrance of the passageway. When installing each panel it is important that the lower panel member 25 be forced down into pressure engagement with the floor of the mine passageway and that the upper panel member 27 be forced up into pressure engagement with the roof of the passageway, so that when the upper and lower panel members are secured in fixed position relative to one another. Such pressure engagement assists in holding the panel rigid and stable. A jack of the type described in U.S. Pat. No. 4,483,642 may be used to install the panels 3 to ensure such pressure engagement. As the back wall is erected, horizontally aligned groups of tie bars 31 are mounted at appropriate locations, with the tie bars in each group being held in a position in which they project from the wall by a brace 41 passing through the chevron-shaped openings 35 in the rearward ends of the tie bars. Each brace 41 is secured to respective panels 3 of the back wall on the rearward side of the wall by wire ties 15. The other wall (e.g. W1) is then erected in essentially the same manner as the first-mentioned wall (e.g. W2) including tie bars 31. As erected, walls W1 and W2 have the keying bars 45, 47 and 49 on their inside faces.

Once both walls W1, W2 of the form have been installed, filling material such as concrete may be poured into the space between the forms. Access to the space for pouring is preferably through a suitable gap (or gaps) between the top of a panel (or panels) and the roof of the passageway, the gap being due either to an irregularity in the roof or because the panel was deliberately not extended all the way up to the roof. As the filling is poured in, the tie bars 31 hold the panels forming the walls W1 and W2 in fixed position against outward movement away from one another. The filling sets up to its final state in which it has the force-transmitting relationship with the walls and sufficient strength in tension as well as in compression to constitute the walls and the filling as a permanently integrated composite structure in which the walls act as flanges in conjunction with the filling as a web resistant to forces such as may be encountered in the passageway tending to bend the structure in one direction or the other longitudinally of the passageway.

Figure 6:
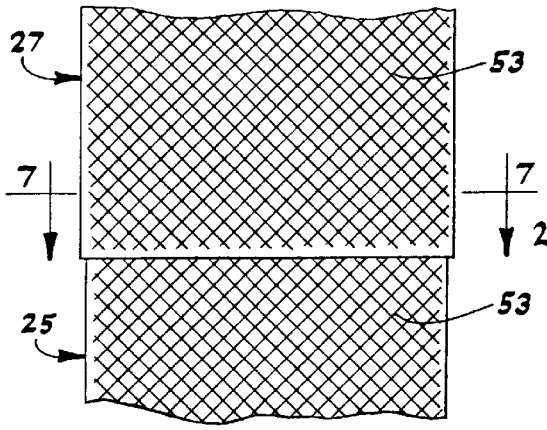
FIG. 6 is a view in elevation of the inside face of part of a first modification of the extensible panel used in constructing a first modification of the stopping of this invention.
Figure 7:
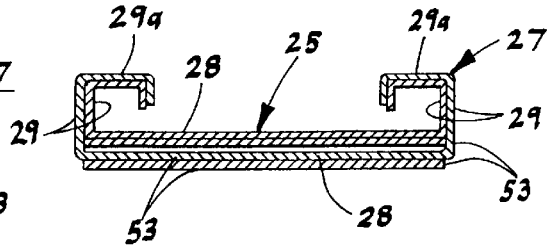
FIG. 7 is a view in horizontal section on line 7—7 of FIG. 6.

In a modification of the invention, illustrated in FIGS. 6 and 7, the keying means may be constituted by having expanded steel mesh 53 tack welded to the faces of the webs 28 of the panels 45, 47 that become the inside faces of the walls, the filling becoming keyed to the walls by the bars. In the construction using such mesh on the panels, the webs of the panel members 25, 27 may be slightly spaced as appears in FIG. 7 so that the mesh lies between the webs to enable a full range of sliding movement of one panel member relative to the other for substantial extension of the panel.

Figure 8:
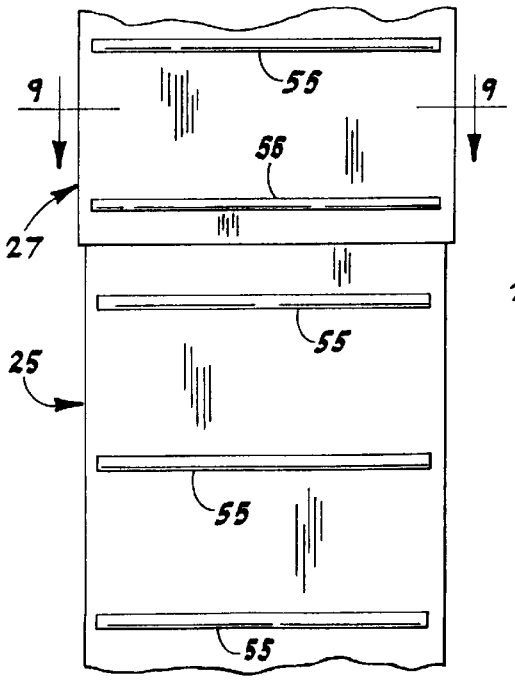
FIG. 8 is a view in elevation of the inside face of part of a second modification of the extensible panel used in constructing a second modification of the stopping of this invention.
Figure 9:
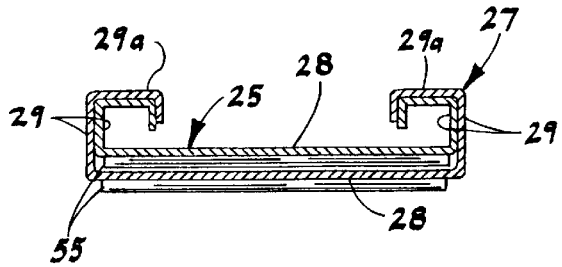
FIG. 9 is a view in horizontal section on line 9—9 of FIG. 8.

In another modification, illustrated in FIGS. 8 and 9, the keying means may be constituted by lengths of steel bars 55 (e.g. lengths of reinforcing bar stock) welded to the face of the webs of the panels 45, 47 that become the inside faces of the walls, the filling becoming keyed to the walls by the bars. In the construction using such bars on the panels, the webs of the panel members 25, 27 may be spaced as appears in FIG. 9 so that the bars lie between the webs to enable a full range of sliding movement of one panel member relative to the other for substantial extension of the panel.

Figure 10:
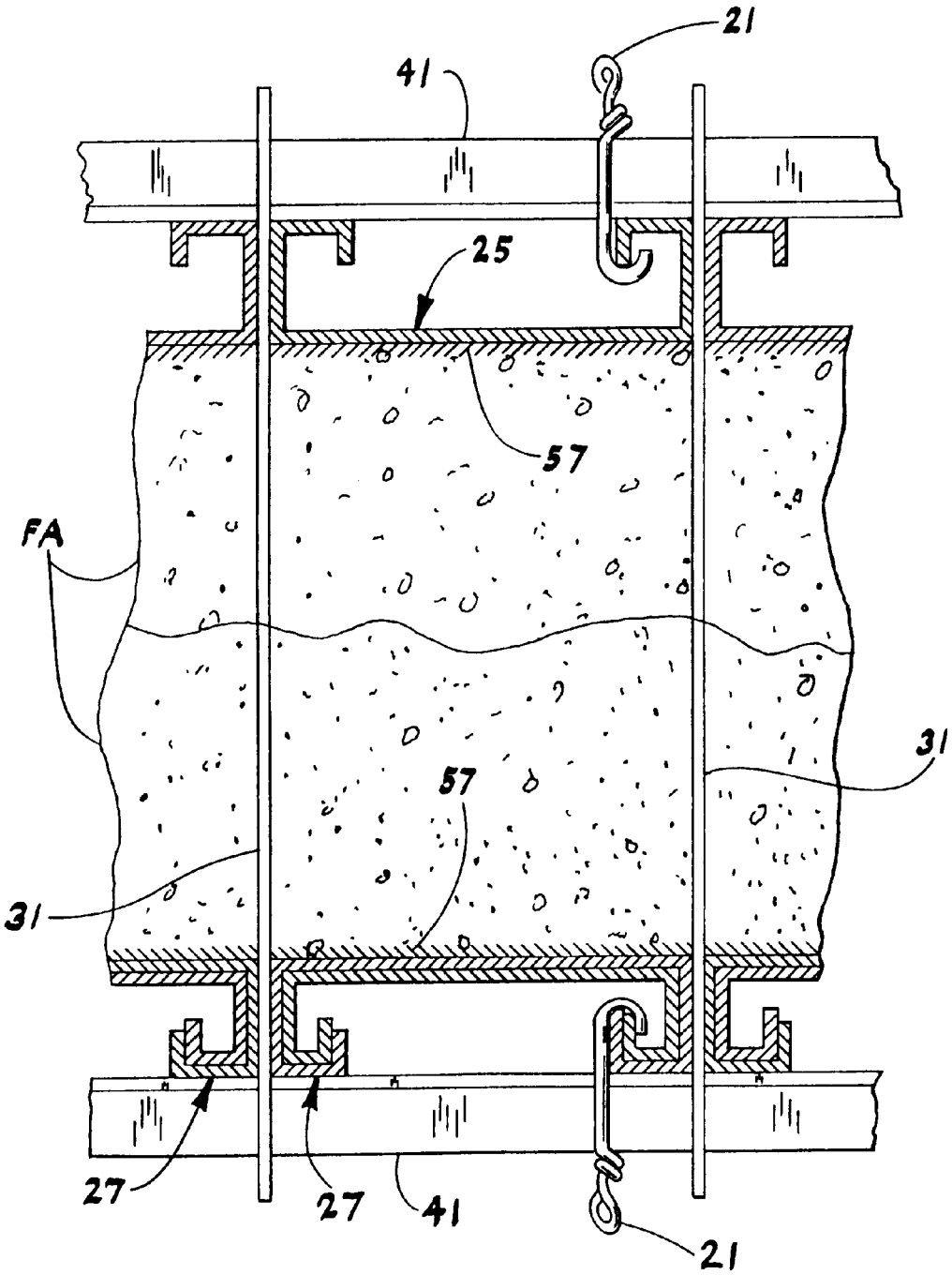
FIG. 10 is a view similar to part of FIG. 3 showing a third modification of the stopping of this invention, half in horizontal section on a horizontal plane through the lower panel members of panels of the stopping, half in horizontal section through the upper panel members of said panels.

In yet another modification, illustrated in FIG. 10, the force-transmitting relationship of the filling and the walls is established by use for the filling of a material which is self-adherent to the faces of the webs of the extensible panels that become the inside faces of the walls so that, in the final construction with the material set in its final state between the walls, the filling (designated FA) is adhesively bonded to said faces as indicated at 57. In this embodiment, the filling FA may be the above-noted flame-inhibited polyurethane foam material.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A stopping for a passageway in a mine comprising first and second walls extending transversely of the passageway from one side thereof to the other and heightwise of the passageway from the floor to the roof thereof, said walls being permanently held in generally vertical parallel relation spaced apart longitudinally of the passage and held against displacement longitudinally of the passageway, and a filling in the space between the walls having a force-transmitting relationship with the walls, each of said walls and filling having strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway.

2. A stopping as set forth in claim 1 wherein the force-transmitting relationship of the filling and the walls is established by adhesive bonding of the filling and the walls.

3. A stopping as set forth in claim 1 wherein each wall comprises a set of elongate extensible panels, each set including a plurality of said panels erected to extend vertically in side-by-side relation from the floor to the roof of a passageway in a mine, each panel comprising a first elongate sheet metal member constituting a lower member of the panel in engagement at its lower end with the floor of the passageway, and a second elongate sheet metal member constituting an upper member of the panel in engagement at its upper end with the roof of the passageway, said members having a telescoping sliding fit with one another to permit adjustable extension of the panel to fit the height of the passageway, and means for holding the walls in their said spaced, generally parallel relation.

4. A stopping for a passageway in a mine comprising first and second walls extending transversely of the passageway from one side thereof to the other and heightwise of the passageway from the floor to the roof thereof, said walls being permanently held in generally vertical parallel relation spaced apart longitudinally of the passage and held against displacement longitudinally of the passageway, and a filling in the space between the walls having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway, and wherein the walls are sheet metal walls and the force-transmitting relationship of the filling with the walls is established by means on the inside faces of the walls keying the filling and the walls together.

5. A stopping as set forth in claim 4 wherein the walls are sheet metal walls and the keying means comprises metal bars secured to the inside faces of the walls and embedded in the filling.

6. A stopping as set forth in claim 4 wherein the keying means comprises steel mesh welded to the inside faces of the walls and embedded in the filling.

7. A stopping for a passageway in a mine comprising first and second walls extending transversely of the passageway from one side thereof to the other and heightwise of the passageway from the floor to the roof thereof, said walls being permanently held in generally vertical parallel relation spaced apart longitudinally of the passage and held against displacement longitudinally of the passageway, and a filling in the space between the walls having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway, wherein the force-transmitting relationship of the filling and the walls is established by adhesive bonding of the filling and the walls, and wherein the filling is flame-inhibited polyurethane foam material.

8. A stopping for a passageway in a mine comprising first and second walls extending transversely of the passageway from one side thereof to the other and heightwise of the passageway from the floor to the roof thereof, said walls being permanently held in generally vertical parallel relation spaced apart longitudinally of the passage and held against displacement longitudinally of the passageway, and a filling in the space between the walls having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway, each wall comprising a set of elongate extensible panels, each set including a plurality of said panels erected to extend vertically in side-by-side relation from the floor to the roof of a passageway in a mine, each panel comprising a first elongate sheet metal member constituting a lower member of the panel in engagement at its lower end with the floor of the passageway, and a second elongate sheet metal member constituting an upper member of the panel in engagement at its upper end with the roof of the passageway, said members having a telescoping sliding fit with one another to permit adjustable extension of the panel to fit the height of the passageway, and means for holding the walls in their said spaced, generally parallel relation, and wherein the force-transmitting relationship of the filling with the walls is established by means on the inside faces of at least some of the panel members keying the filling and said members together.

9. A stopping as set forth in claim 8 wherein the keying means comprises metal bars secured to the inside faces of the respective panel members and embedded in the filling.

10. A stopping as set forth in claim 8 wherein the keying means comprises metal bars having a straight reach and end portions bent to extend laterally from the ends of the straight reach, said end portions of each bar being welded at their ends to the inside face of a respective panel member providing a space between the straight reach of the bar and said inside face, the filling penetrating said space.

11. A stopping as set forth in claim 10 wherein said bars extend vertically and are so located on the panel members as to enable substantial contraction of each panel without interference from said bars.

12. A stopping as set forth in claim 11 wherein one member of at least some of the panels has an auxiliary bar secured at one end on the inside face thereof with a space therebetween, said auxiliary bar extending lengthwise of the panel slidably through a guide on the inside face thereof with a space between said auxiliary bar and the respective panel members penetrated by the filling.

13. A stopping as set forth in claim 8 wherein the keying means comprises steel mesh welded to the inside faces of the walls and embedded in the filling.

14. A stopping as set forth in claim 8 wherein the force-transmitting relationship of the filling and the walls is established by adhesive bonding of the filling and the walls.

15. A stopping as set forth in claim 14 wherein the filling is flame-inhibited polyurethane foam material.

16. The method of providing a stopping for a passageway in a mine comprising:

installing first and second walls extending transversely of the passageway generally from one side thereof to the other and lengthwise of the passageway from the floor to the roof thereof each wall comprising a set of elongate extensible panels, each set including a plurality of said panels erected to extend vertically in side-by-side relation from the floor to the roof of a passageway in a mine, each panel comprising a first elongate sheet metal member constituting a lower member of the panel installed to have its lower end in engagement with the floor of the passageway, and a second elongate sheet metal member constituting an upper member of the panel installed to have its upper end in engagement with the roof of the passageway, said members having a telescoping sliding fit with one another to permit adjustable extension of the panel to fit the height of the passageway;

said walls as installed being permanently held in generally vertical parallel relation spaced apart longitudinally of the passageway and held against displacement longitudinally of the passageway;

filling the space between the walls with a material initially in a fluent state and adapted to set in situ to a final state wherein it has strength in tension as well as compression;

said material being poured into said space in its fluent state and allowed to set in situ to its hardened state; and providing a force-transmitting relationship between the filling and the walls, each of the walls and the filling in its final state having strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passage.

17. A panel for use in constructing a stopping of the type comprising first and second sheet metal walls extending transversely of a passageway in a mine from one side thereof to the other and lengthwise of the passageway from the floor to the roof thereof, said walls being permanently held in generally vertical parallel relation spaced apart longitudinally of the passage and held against displacement longitudinally of the passageway, and a filling in the space between the walls having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway, said panel comprising a first elongate sheet metal member constituting a lower member of the panel for engagement at its lower end with the floor in the passageway, and a second elongate sheet metal member constituting an upper member of the panel for engagement at its upper end with the roof of the passageway, said member having a telescoping sliding fit with one another to permit adjustable extension of the panel to fit the height of the passageway, each member of the panels having an inside face and an outside face in respect to incorporation of the panel in a stopping, each member having on the inside face thereof means for keying the filling and said members together to establish said force-transmitting relationship.

18. A panel as set forth in claim 17 wherein the keying means comprises metal bars secured to the inside faces for embedment in the filling.

19. A panel as set forth in claim 17 wherein the keying means comprises metal bars having a straight reach and end portions bent to extend laterally from the ends of the straight reach, said end portions of each bar being welded at their ends to the inside face of a respective panel member providing a space between the straight reach of the bar and said inside face for penetration by the filling.

20. A panel as set forth in claim 19 wherein said bars extend vertically and are so located on the panel members as to enable substantial contraction of each panel without interference from said bars.

21. A panel as set forth in claim 20 wherein one member of at least some of the panels has an auxiliary bar secured at one end on the inside face thereof with a space therebetween, said auxiliary bar extending lengthwise of the panel slidably through a guide on the inside face of the other member of the panel with a space between said auxiliary bar and the respective panel members for penetration by the filling.

22. A panel as set forth in claim 17 wherein the keying means comprises steel mesh welded to said inside faces.

23. A stopping for a passageway in a mine comprising first and second walls extending transversely of the passageway from one side thereof to the other and heightwise of the passageway from the floor to the roof thereof, said walls being permanently held in generally vertical parallel relation spaced apart longitudinally of the passage and held against displacement longitudinally of the passageway, and a filling in the space between the walls having a force-transmitting relationship with the walls and having sufficient strength in tension to constitute the walls and the filling as a permanently integrated composite structure in which the walls act as flanges in conjunction with the filling as a web resistant to forces such as may be encountered in the passageway tending to bend the structure in one direction or the other longitudinally of the passageway, each wall comprising a set of elongate extensible panels, each set including a plurality of said panels erected to extend vertically in side-by-side relation from the floor to the roof of a passageway in a mine, each panel comprising a first elongate sheet metal member constituting a lower member of the panel in engagement at its lower end with the floor of the passageway, and a second elongate sheet metal member constituting an upper member of the panel in engagement at its upper end with the roof of the passageway, said members having a telescoping sliding fit with one another to permit adjustable extension of the panel to fit the height of the passageway, and means for holding the walls in their said spaced, generally parallel relation, and wherein the force-transmitting relationship of the filling and the walls is established by adhesive bonding of the filling and the walls.

* * * * *